US005457917A

United States Patent [19]

Palmersten

[11] Patent Number: 5,457,917

[45] Date of Patent: Oct. 17, 1995

[54] INTERLOCKING ROOF PANELS WITH BUILT IN PITCH

[75] Inventor: Michael J. Palmersten, Safety Harbor, Fla.

[73] Assignee: Ramp R & D Co., Ormond Beach, Fla.

[21] Appl. No.: 222,994

[22] Filed: Apr. 5, 1994

Related U.S. Application Data

[63] Continuation-in-part of Ser. No. 72,266, Jun. 3, 1993, abandoned.

[51] Int. Cl.[6] ..... E04B 7/02; E04B 1/38

[52] U.S. Cl. ..... 52/91.3; 52/90.2; 52/588.1; 52/592.4

[58] Field of Search ..... 52/90.2, 91.1, 52/91.3, 520, 523, 525, 536, 546, 560, 478, 588.1, 589.1, 592.1, 592.4, 809

[56] References Cited

U.S. PATENT DOCUMENTS

| | | | |
|---|---|---|---|
| 2,023,814 | 12/1935 | Lindsey | 52/91.3 |
| 4,130,975 | 12/1978 | Kelly | 52/588 |
| 4,221,087 | 9/1980 | Lowe | 52/91.3 |
| 4,769,963 | 9/1988 | Meyerson | 52/588 |

FOREIGN PATENT DOCUMENTS

| | | | |
|---|---|---|---|
| 2301655 | 9/1976 | France | 52/90.1 |
| 884690 | 7/1953 | Germany | 52/91.1 |
| 1567161 | 5/1980 | United Kingdom | 52/588 |

*Primary Examiner*—Michael Safavi
*Attorney, Agent, or Firm*—Joseph C. Mason, Jr.; Ronald E. Smith

[57] ABSTRACT

Modular roof panels having sloped top surfaces and flat bottom surfaces are interlocked in edge-to-edge relation to one another to form a monolithic roof where the roof is pitched to provide moisture run off but where the space covered by the roof has a ceiling that is not pitched. Thus, the side walls of the structure have a common height. In a first embodiment, the top and bottom surfaces of the panels are covered with a skin, and in a second embodiment only the top surface is so covered. The first embodiment is used in original roof construction and the second is used in roofover construction. In both embodiments, the core material is preferably expanded polystyrene and the skin is preferably metallic. The skins are bent to interlock contiguous panels.

8 Claims, 7 Drawing Sheets

INTERLOCKING ROOF PANELS WITH BUILT IN PITCH

This application is a continuation-in-part of U.S. application Ser. No. 08/072,266, filed Jun. 3, 1993, now abandoned.

BACKGROUND OF THE INVENTION

1. Field of the Invention

This invention relates, generally, to building construction. More particularly, it relates to a modular roof panel construction where the slope of the roof is built into the panel.

2. Description of the Prior Art

Expanded polystyrene (EPS) is used extensively in the construction industry because it is light in weight yet strong and inexpensive. For example, its closest competitor, urethane foam, costs about three times as much.

EPS is also desirable because it can be cut into different shapes with some ease. Architects often specify its use when placing decorative columns or other designs on the facade of a building. More commonly, however, it is used in roof construction or as a supplemental roof known as a roofover.

Since EPS is quite brittle, however, it is covered with a thin metallic skin if it is being used not as a decoration but as a working part of a structure. A suitable adhesive is employed to bond the skin to the EPS core.

In the roofing industry, EPS panels are often used to overlie existing roofs to enhance the insulation of the space below the roof and to seal the roof against leakage. Typically, EPS roofing panels are of modular construction so that a plurality of panels may be combined to form a monolithic roof. Numerous patents have been awarded on interlocking means that facilitate the quick and easy joinder of individual panels, that prevent leakage of moisture through the seams, and so on.

All of the EPS roofing panels of the prior art share a common feature: uniform thickness. Regardless of the size of the panel, the type of interlocking means employed, whether a metal skin is used on one or two sides thereof, etc., the thickness of the panel is always uniform along the extent and breadth thereof.

Thus, all EPS roof panels heretofore known cause the same problems in the roof construction industry that are caused by the other materials used in the industry. To properly slope a roof, either a truss or other support surface having the desired slope must be built to support the roof atop walls having a common height, or the walls of the structure must be built to accommodate the slope.

When the latter technique is employed, no two of the wall sections will have the same configuration. More particularly, each wall section will have a slope built into its top edge, and that slope must match the slope of the contiguous wall sections.

Thus, the ceiling of the structure being provided with such a roof will be lower at its outermost edge than at its innermost edge, i.e., the downward slope of the roof translates into a downward slope of the interior ceiling of the space being roofed. Thus, the occupants of the space lose headroom as they approach the outer wall of the structure.

Moreover, a structure with such a roof is less appealing aesthetically than is a structure where the end walls have a common height.

If an EPS roof panel construction could be discovered that would enable add on rooms, for example, to have pitched roofs but unpitched ceilings, such a panel would revolutionize the construction industry.

No EPS roof panel construction of the prior art teaches or suggests how such a leap in construction industry technology could be accomplished.

In the urethane panel construction industry, U.S. Pat. No. 3,792,141 to Offutt shows what is called a "roof structure" that has a built in pitched roof and a flat bottom; however, it is well known in the urethane industry that urethane foam expands with enormous force as it cures, and that, consequently, large masses are required to mold urethane items of large sizes. Thus, the construction of a urethane panel large enough to form a part of a modular roof is not believed to be within the realm of practicality. Perhaps even more importantly, the Offutt construction teaches away from modular panels having edge-to-edge interlocking means.

When the prior art is viewed as a whole and in its entirety, the vast scope and content of such art suggests, at most, continued evolutionary change; a breakthrough-type development in this art would not have been obvious to one of ordinary skill in this art at the time this invention was made.

SUMMARY OF THE INVENTION

The very longstanding but heretofore unfulfilled need for an EPS roof panel construction that obviates the need to slope roofs and ceilings at a common pitch is now fulfilled by interlocking EPS panels having flat bottoms and pitched tops.

In a first illustrative embodiment, the top and bottom surfaces of the panels are covered with a metallic skin; in a second illustrative embodiment, only the top surface is so covered. Both embodiments include the use of cores of non-EPS construction.

The first embodiment has utility in those constructions where the EPS panels are employed as the primary roofing material; the second embodiment has utility where EPS panels are placed over an existing roof to enhance its insulation or for other reasons.

In both embodiments, a side elevational view of the panels shows a flat bottom and a sloping top, i.e., the top and bottom of the panel are oblique with respect to one another; the angle of the top surface determines the pitch of the roof. Thus, a space covered by either embodiment—even though only the first embodiment would be employed in original construction—would have a flat ceiling. Thus, the side walls of the structure will have a common height, thereby obviating the need for a truss or to custom build the supporting walls as required when roof panels of uniform thickness are employed. In new construction, accordingly, the add on look will be avoided and the appearance of a conventionally built roof will be provided.

The second embodiment also includes novel means for securing the panels to the existing roof. Importantly, said novel means is not visible when the roof has been completed. Just as importantly, the novel means eliminates the need for throughbores through the panels.

The primary object of this invention is to make obsolete the uniform thickness EPS roof panels of the prior art.

A closely related object is to make obsolete add on structures having sloped interior ceilings.

A general object is to advance the arts of original roof construction and roofover construction in a pioneering fashion.

A more specific object is to provide invisible hold down means for roofover panels.

These and many other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
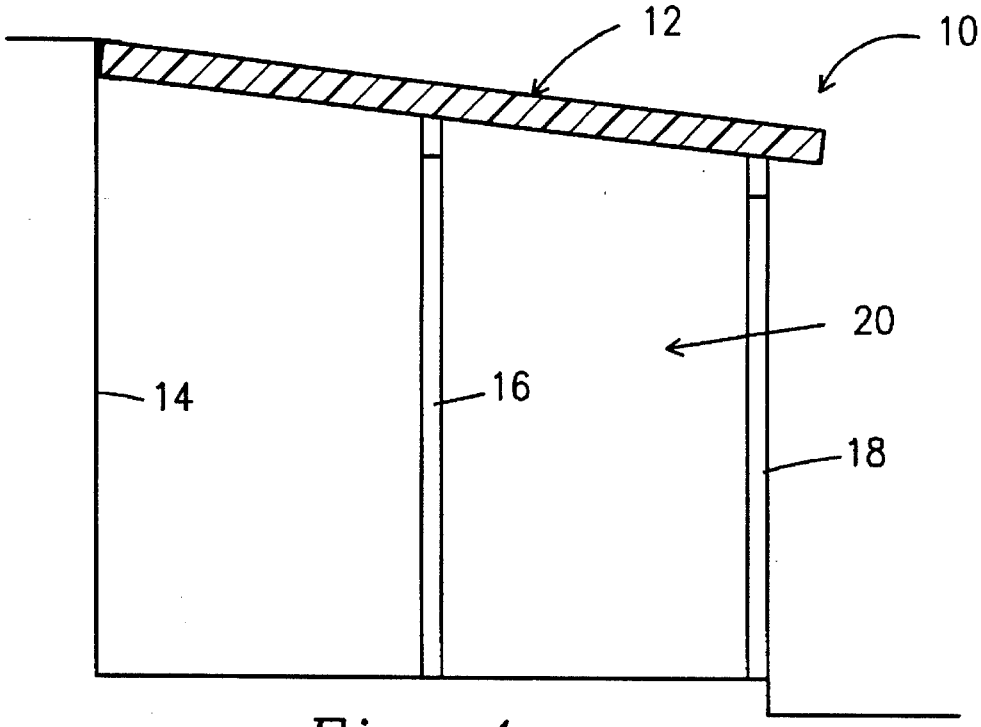
Fig. 1 PRIOR ART
FIG. 1 is a sectional, side elevational view of an add on room having a foam core roof made in accordance with the teachings and suggestions of the prior art.

Referring first to FIG. 1, it will there be seen that an add on room or other structure made in accordance with the techniques of the prior art is denoted 10, generally. It is critical to note that the EPS roof panels 12 that have been employed to construct the roof have a common thickness. Moreover, note that inner wall 14 has a height greater than central support post 16, and central support post 16 has a height greater than outer wall 18. It follows that the wall sections lying in the plane of the paper have different contours because their respective upper edges must match the slope of the roof 12; accordingly, an installation of this type requires custom making of the support posts, the outer wall, and the side walls, i.e., the walls in the plane of the paper. Just as importantly, the occupants of space 20 have less headroom when standing near outer wall 18 than when standing near inner wall 14. Furthermore, the aesthetic appearance of the structure 10 is nominal, i.e., the structure 10 has an unpleasant added-on look.

Figure 2:
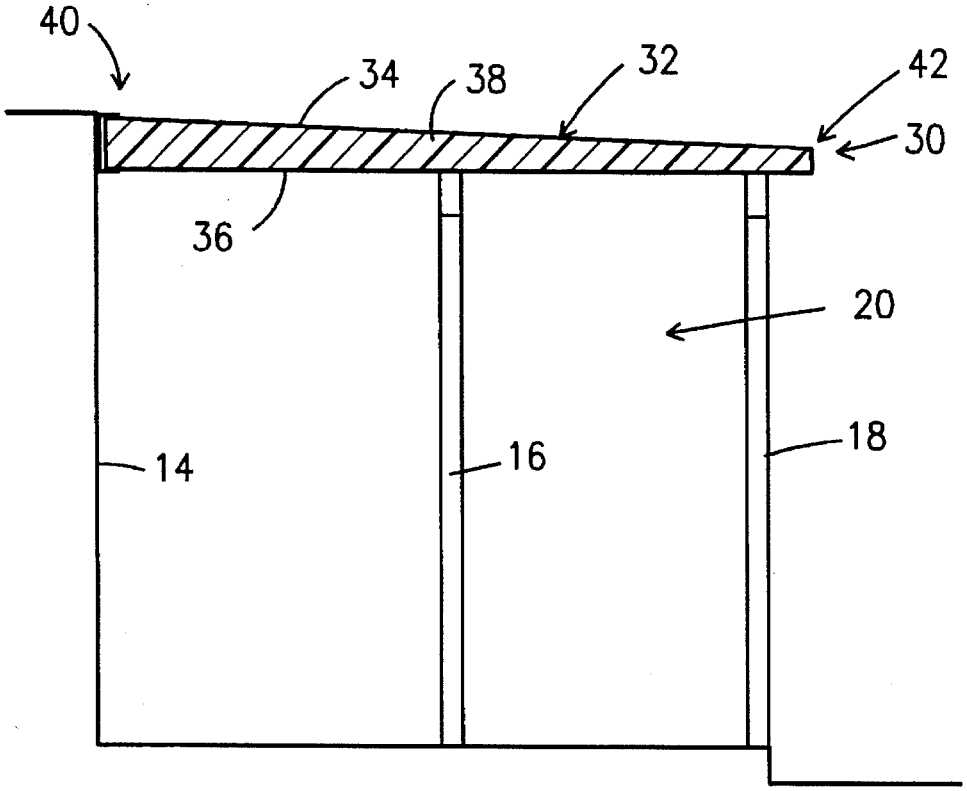
FIG. 2 is a sectional, side elevational view of an add on room made in accordance with the teachings and suggestions of the present invention.

Referring now to FIG. 2, it will there be seen that an embodiment of the invention that illustrates a preferred expression thereof is denoted as a whole by the reference numeral 30. Walls and support posts 14, 16, and 18 maintain their designations from FIG. 1, but it should be observed that support post 16 and outer wall 18 are now of the same height as inner wall 14, and that, accordingly, the wall sections in the plane of the paper have a common configuration. Specifically, the building construction of FIG. 2 includes a plurality of roof panels disposed in edge-to-edge relation with one another, in combination with a plurality of wall panels of uniform height disposed in edge-to-edge relation with one another.

Thus, the space denoted 20 has a common head room throughout. This is achieved by the provision of the novel panels 32, only one of which can be seen in this side elevational view, that are employed to provide the roof for structure 30. Note that the top 34 of each panel 32 is sloped to provide the needed pitch, and that the bottom 36 of the panels is not sloped; thus, occupants of space 20 see a ceiling having a uniform height and external observers of the structure 30 see an aesthetically pleasing room having the appearance of an original construction.

The taper of roof 30 is adjustable so that any pitch can be provided. Significantly, the oblique relationship of top surface 34 and bottom surface 36 was heretofore unknown in the EPS roof construction industry.

It should of course be understood that the novel roof is made from a plurality of panels 32 that are interlocked with one another along their abutting edges. In FIG. 2, an edge of panel 32 is denoted 38. EPS panels, typically, have a breadth of about four feet; thus, where an add on room is twenty feet in length, five panels 32 disposed in edge-to-edge relation would be required to provide the needed roof. Where the add on room is sixteen feet in width, i.e., where the distance between inner wall 14 and outer wall 18 is sixteen feet, then each panel 32 would be sixteen feet in length. Clearly, depending upon the width of the room and the desired pitch of the roof, the difference in thickness of the panels at their innermost ends 40 and their outermost ends 42 will vary, i.e., the amount of taper of panels 32 will vary.

Figure 3:
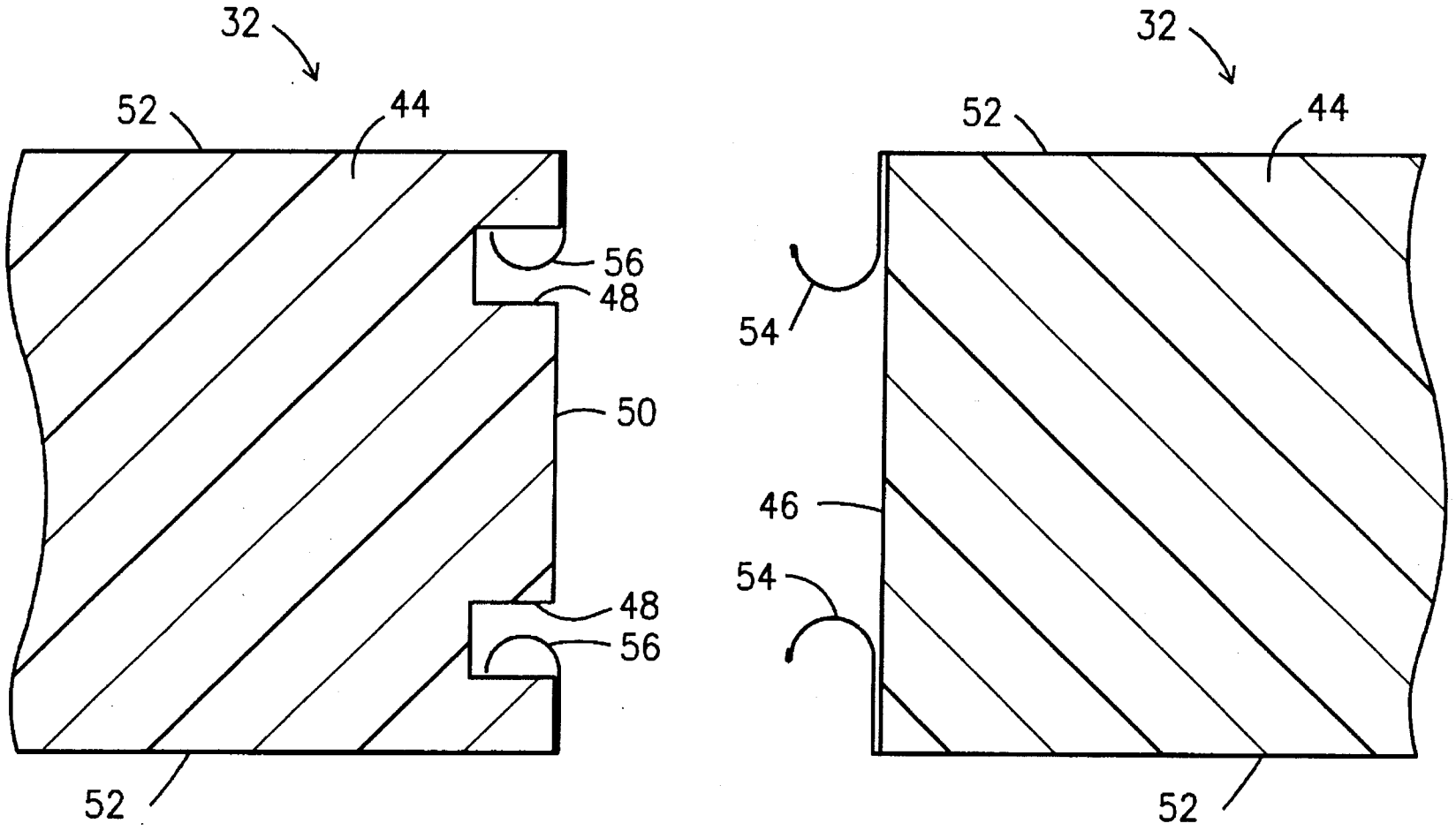
FIG. 3 is a side elevational view of the mating edges of the modular panels of the present invention when disposed in spaced apart relation to one another.

A pair of contiguous panel 32 edges are shown in FIG. 3. The foam core 44 of a first edge is unsculpted as at 46, and the foam core 44 of a second edge has sculpted therein a pair of square channel groove members, collectively denoted 48. Edges 50 and 46 thus abut one another when the panels are interlocked with one another. Each foam core is covered with a metallic skin 52 that is bonded thereto to protect it. The skin that protects the panel having the unsculpted panel edge 46 is bent at said edge into the form of an outwardly projecting "J"-shaped hook 54. Each hook 54 is accommodated within its associated groove 48 when the panels are interengaged to one another, and each hook engages a complementally formed inwardly projecting "J"-shaped hook 56 that is positioned within said grooves 48.

Figure 4:
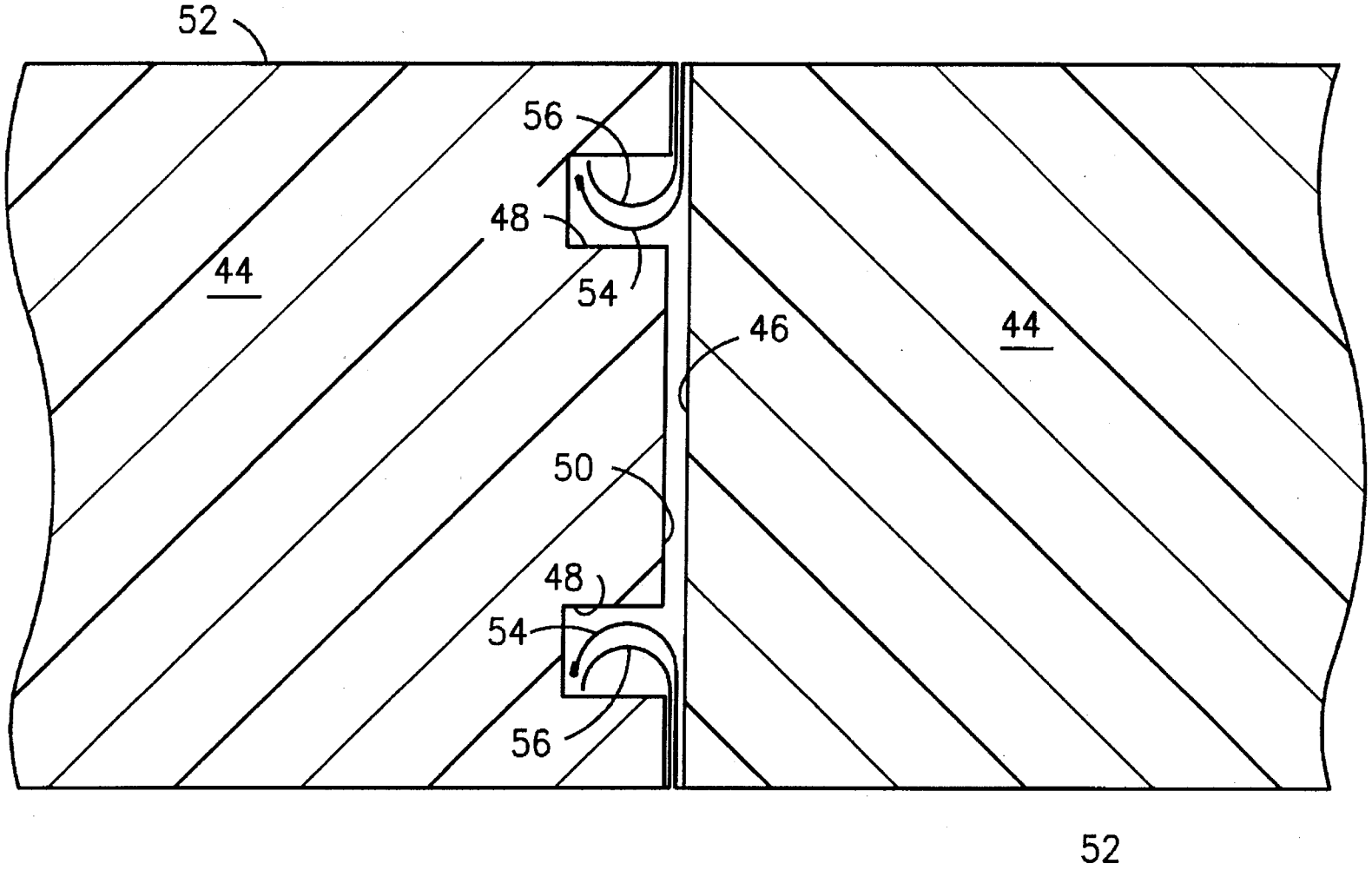
FIG. 4 is a side elevational view of the panels shown in FIG. 3 when said panels are interlocked with one another.

FIG. 4 shows the panels of FIG. 3 when so interengaged. The gap between edges 46 and 50 does not appear in the commercial embodiment of the invention and is depicted merely to better explain the structure of the inventive panels.

Figure 5:
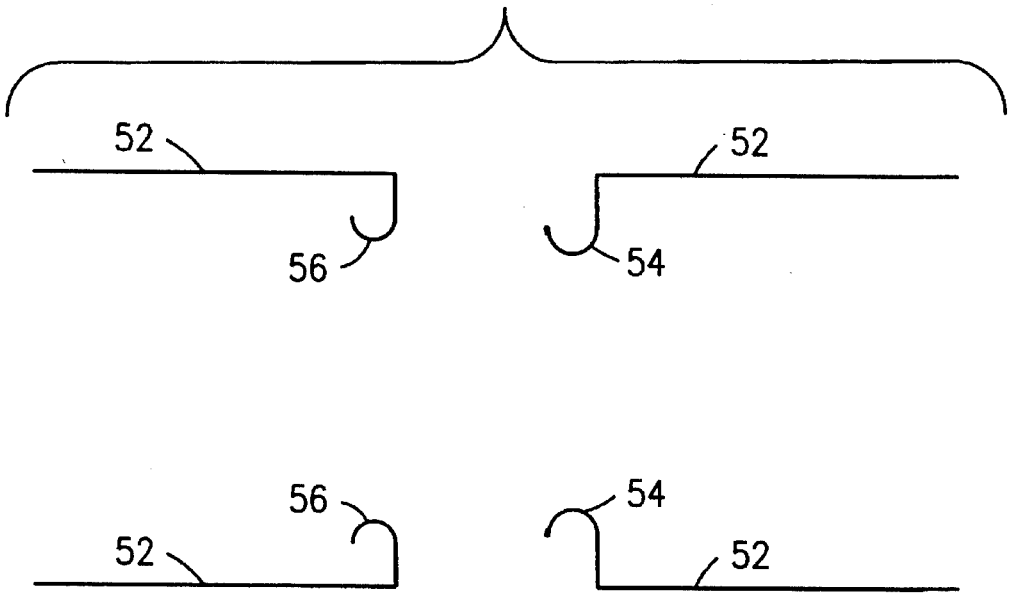
FIG. 5 is a diagrammatic view similar to FIG. 3, but without the core so that the configuration of the skins can be better seen.

FIG. 5 shows panels 32 without their respective cores 44 so that only skins 52 remain; this Fig. is provided so that the "J"-shaped hooks 54 and 56 can be better seen.

Figure 6:
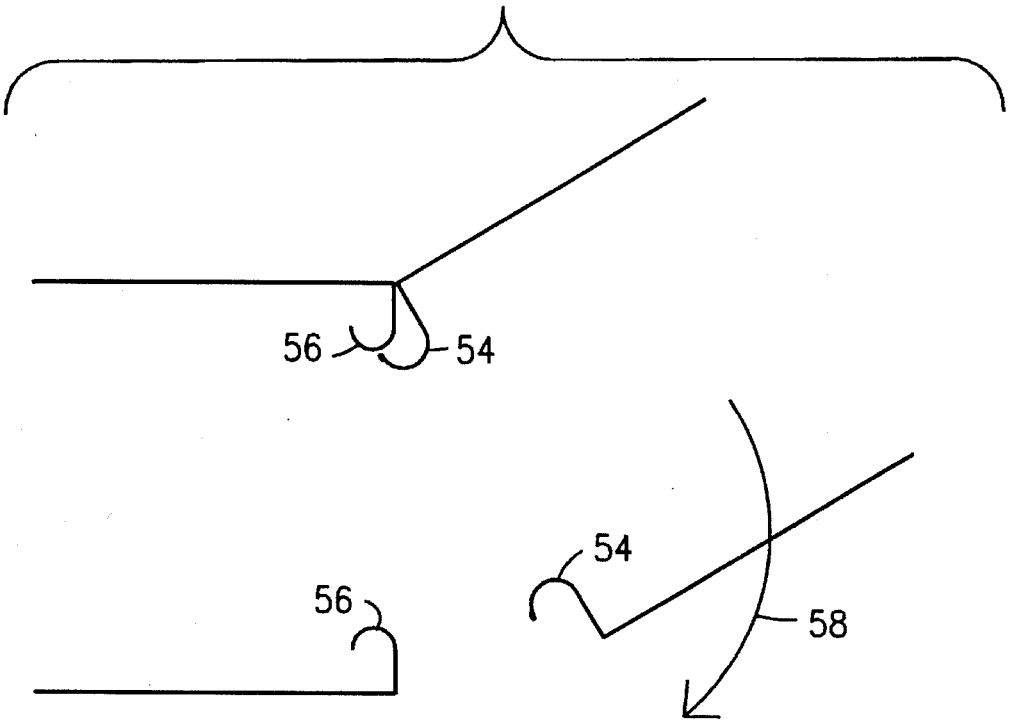
FIG. 6 is a diagrammatic view showing how the skins of FIG. 5 are interlocked with a simple motion.

FIG. 6 shows how said hooks 54 and 56 are brought into interlocking relation to one another; the drawing shows how the panel including hooks 54 is initially tilted with respect to the panel having hooks 56, and directional arrow 58 shows how the tilted panel is rotated to complete the interlocking procedure.

Figure 7:
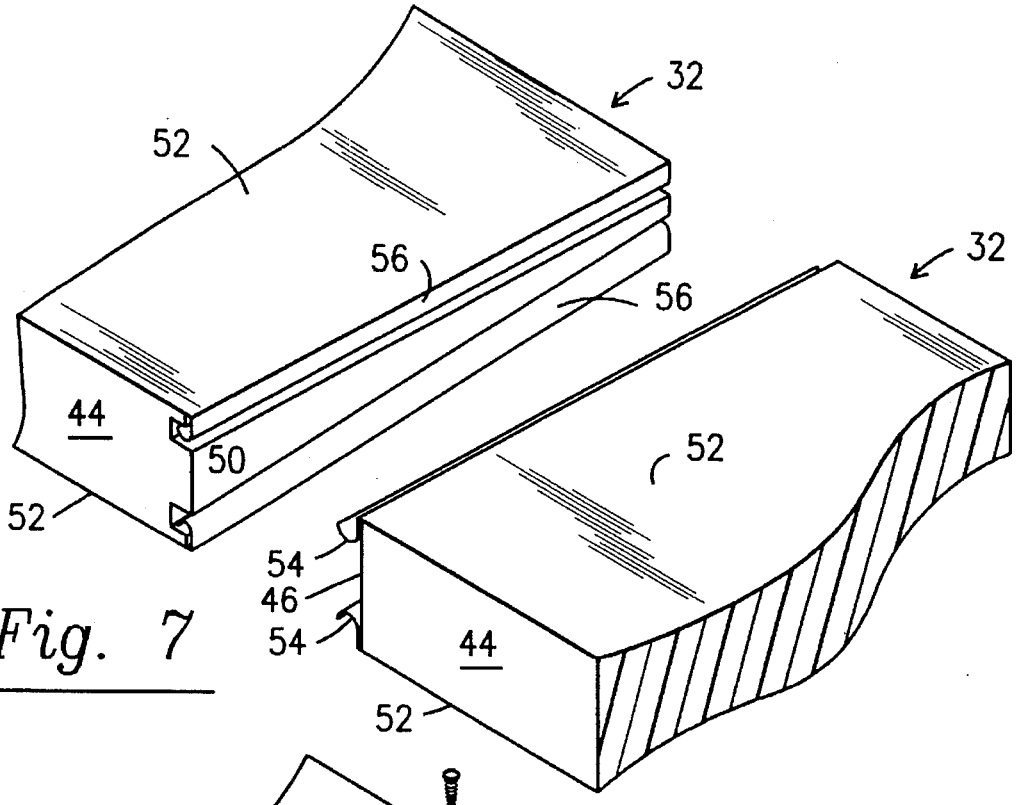
FIG. 7 is a perspective view of a pair of the novel cabana panels of the first embodiment of the present invention, said panels having metallic skin on the top and bottom surfaces thereof.

FIG. 7 shows cabana panels 32, 32 in perspective.

FIGS. 8–12 disclose the second embodiment of the invention.

Figure 8:
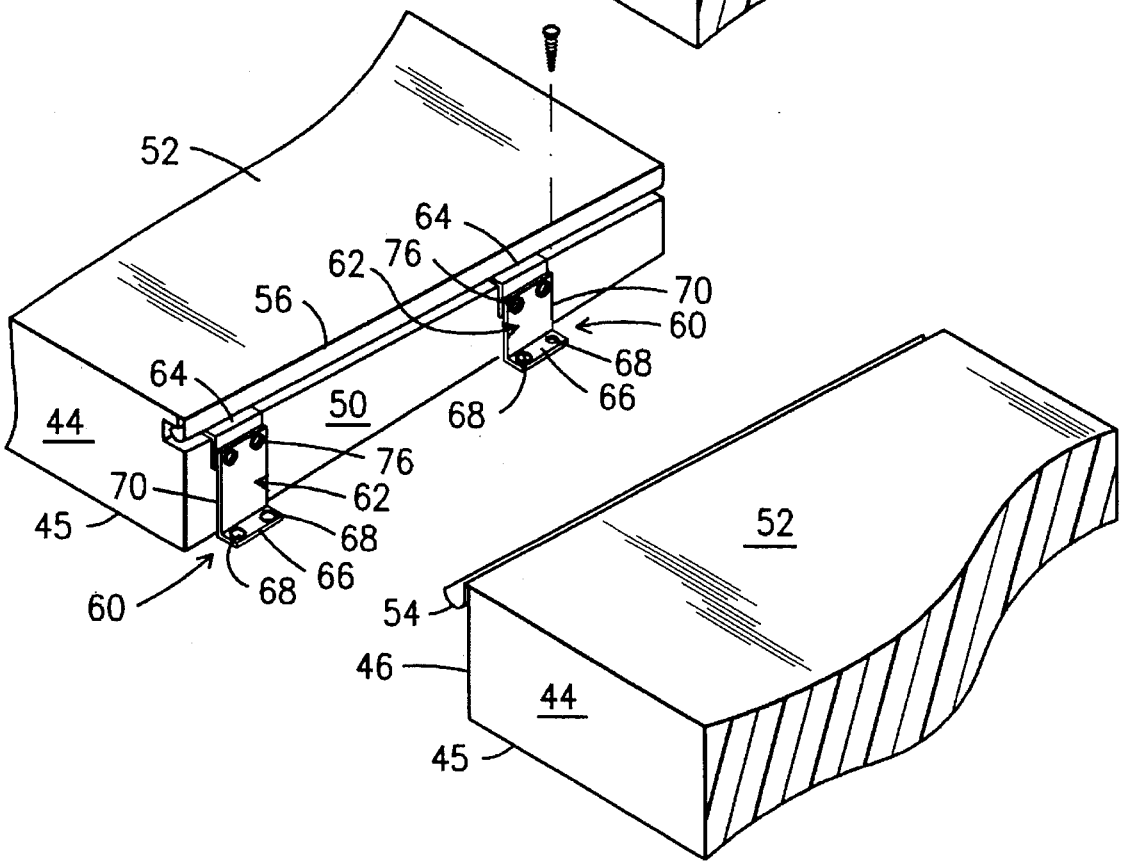
FIG. 8 is a perspective view of a pair of the novel panels of the second embodiment, said panels having a metallic skin only on the top surface thereof.
Figure 9:
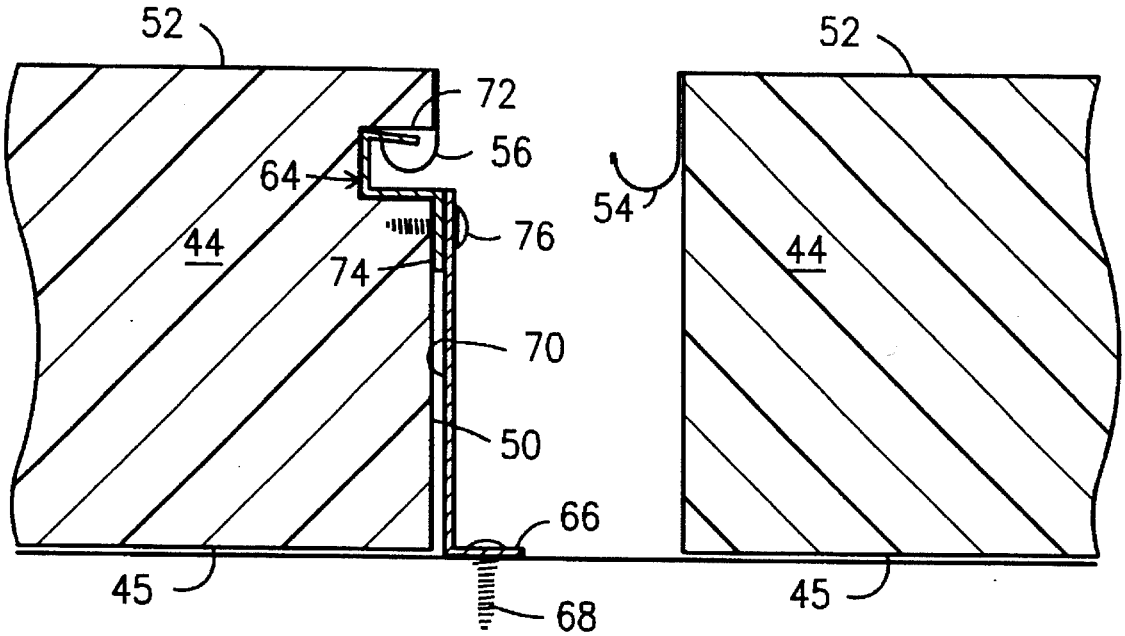
FIG. 9 is a side elevational view of the panels of the second embodiment where one of the panels has been secured to an existing roof in overlying relation thereto.

As shown in FIG. 8, there is only one skin 52 in this embodiment, i.e., the bottom surface 45 of core 44 is uncovered. This embodiment is employed as a roofover to overlie existing roofs made of tar and gravel. Thus, only the top surface of core 44 is covered with a skin 52; the uncovered bottom surface 45, being yieldable, thus conforms to the bumps formed on the existing roof and provides a tight seal thereagainst. Note that the top and only skin 52 of each panel is provided with the "J"-shaped hooks 54 and 56 as in the first embodiment.

In this embodiment, advantageous use is made of the square channel 48 that accommodates hook 56. A first part of a two part bracket is positioned within said channel to facilitate engagement of each panel to the pre-existing roof. In FIG. 8, the two parts of each bracket 60 are denoted 62 and 64, but the construction of each bracket 60 is perhaps best understood in connection with FIG. 9.

Part 62 is "L"-shaped; it includes base 66 that is apertured to receive therethrough a pair of screws 68 that are employed to secure part 62 to the roof of the structure. It further includes upstanding part 70.

Part 64 has a compound shape as shown; it includes a square "U"-shaped part 72 that overlies and lines the square-shaped channel 48, and a straight part 74 that overlies that part of edge 50 just below said channel 48. The uppermost end of upstanding part 70 overlies straight part 74 of part 64 and a bore is formed through both of said parts to accommodate screw 76 that joins said parts together and to foam 44 of the panel. Parts 62 and 64 could be provided as a single piece, but the use of two parts provides the feature of adjustability.

Figure 10:
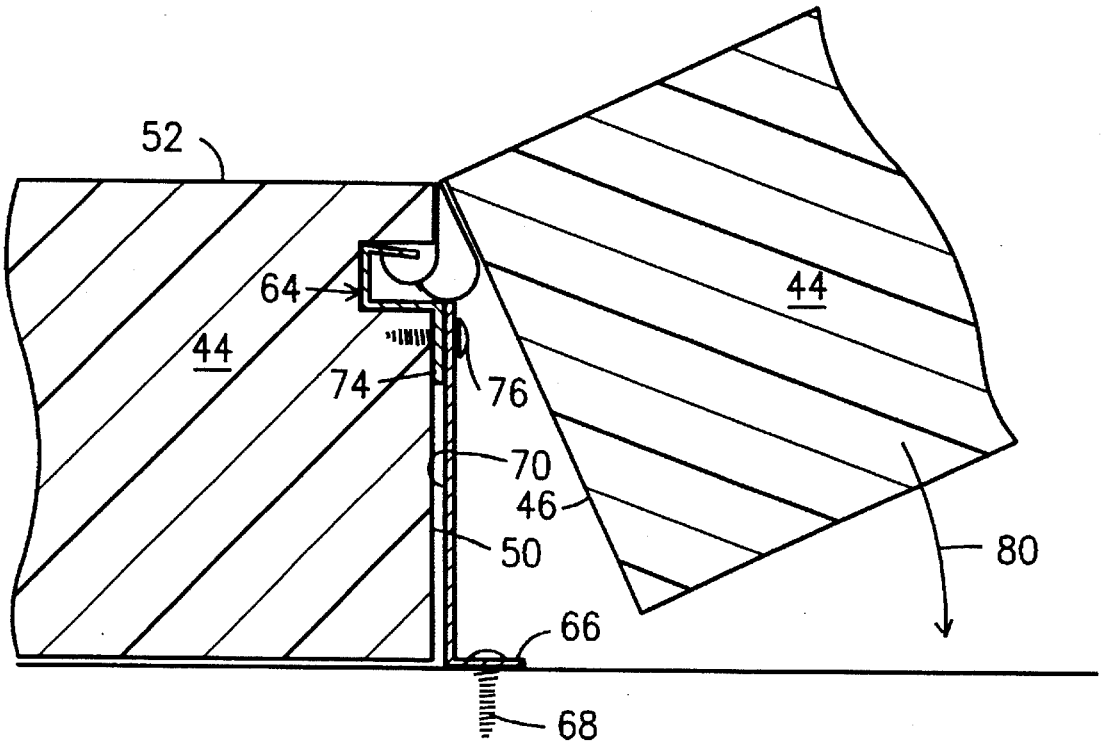
FIG. 10 is a side elevational view similar to FIG. 9, but showing how contiguous panels are interlocked to one another.
Figure 11:
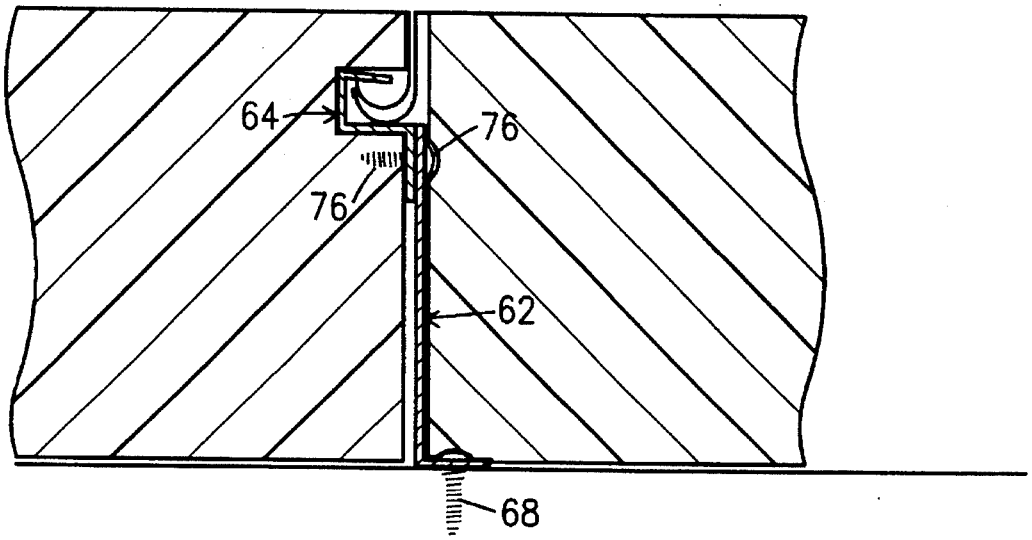
FIG. 11 is a side elevational view similar to FIG. 10, but showing the panels in their fully installed position.

FIGS. 10 and 11 provide an animation showing how the panels are interlocked, with FIG. 10 showing the initial angular tilt and the rotation, indicated by directional arrow 80, required to achieve the interlocked position of FIG. 11. Note how the yieldability of the foam core allows it to conform to the head of the screws 68 and 76. Note also that bracket 60 is completely hidden from view when the novel panels are interlocked. However, this invention also contemplates that the panels could be held down with conventional throughbore attachments.

Figure 12:
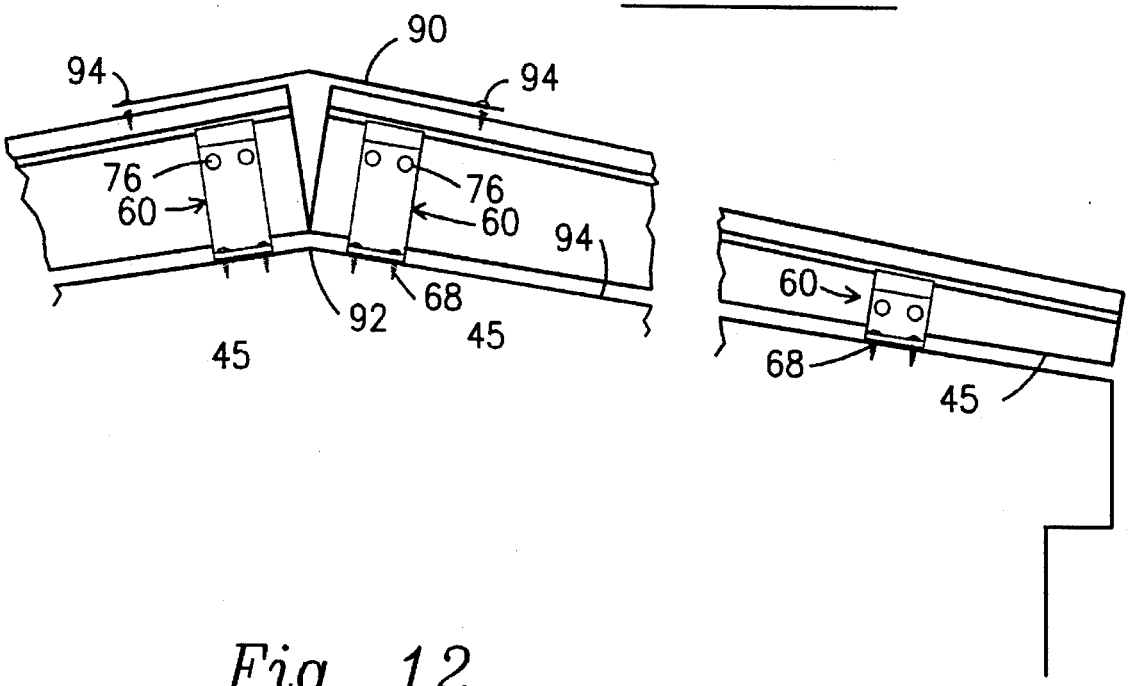
FIG. 12 is a side elevational view showing the panels of the second embodiment installed on a pre-existing pitched roof.

FIG. 12 shows how these novel panels of the second embodiment can be employed as a roofover to a tar and gravel roof that is pitched in two opposite directions. The panels are secured to the roof by novel brackets 60, and a flashing 90 that bridges the gap between the panels at the apex 92 of the roof is then secured to opposing panels by suitable attachment means such as screws 94. The gap at the bottom of each panel, i.e., between panel bottom wall 45 and the surface 94 of the roof, does not exist, but is shown merely to distinguish the roof from the panels.

In all embodiments, the roof panels are interlocked with one another at their respective mating edges and are positioned atop the wall panels to form a room having a roof with a flat bottom surface and a sloped top surface having a predetermined pitch. Thus, a room covered by the novel roof includes a plurality of side walls of uniform height.

This invention is not limited to the specific interlocking means shown; numerous edge-to-edge interlocking means could be employed within the scope of this invention. Moreover, the size of the panels, the materials used for the core and the skins, the hold down means, and other variable parameters may be varied within the scope hereof.

This invention is clearly new and useful, and it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A building construction comprising a plurality of roof panels disposed in edge-to-edge relation with one another, in combination with a plurality of wall panels of uniform height disposed in edge-to-edge relation to one another, interlocking means interlocking said roof panels in said edge-to-edge relation, all of said roof panels having a top surface and a bottom surface that are oblique with respect to one another, each bottom surface being disposed in a horizontal plane, each of said roof panels including a core made of expanded polystyrene and a skin made of a metallic material for covering one of said top and bottom surfaces, said interlocking means including mating edges of said skin that are bent at the edges of each panel, said roof panels being positioned atop said wall panels, a first roof panel having a flat, unsculpted edge and a second roof panel having a sculpted edge disposed in abutting relation to the unsculpted edge of the first panel, said sculpted edge including a pair of "U"-shaped grooves formed therein, said grooves being disposed in oblique relation to one another.

2. The construction of claim 1, wherein a first metallic skin associated with said first panel is bent to form an outwardly projecting "J"-shaped hook and wherein a second metallic skin is bent to form an inwardly projecting "J"-shaped hook that is accommodated within an associated "U"-shaped groove.

3. The construction of claim 1, wherein a top surface of said panel is covered by a skin of a preselected material, and wherein a bottom surface of said panel is uncovered.

4. The construction of claim 3, wherein respective metallic skins that cover the top surfaces of contiguous panels are bent to form said interlocking means.

5. The construction of claim 4, wherein a first panel has a flat, unsculpted edge and wherein a second panel has a sculpted edge disposed in abutting relation to the unsculpted edge of the first panel, said sculpted edge including a square "U"-shaped groove formed therein.

6. The construction of claim 5, further comprising a bracket that secures said second panel to said roof.

7. The construction of claim 6, wherein said bracket includes a first part having a square "U"-shaped configuration that is received within said "U"-shaped groove, and a second, "L"-shaped part that is secured to said roof, said square "U"-shaped part being secured to said "L"-shaped part and to said core of said panel.

8. The construction of claim 7, wherein a first metallic skin associated with said first panel is bent to form an outwardly projecting "J"-shaped hook and wherein a second metallic skin is bent to form an inwardly projecting "J"-shaped hook that is accommodated within an associated "U"-shaped groove.

* * * * *